US005177323A

United States Patent [19]

Kohyama

[11] Patent Number: 5,177,323

[45] Date of Patent: Jan. 5, 1993

[54] DEVELOPING DEVICE FOR DEVELOPING AN ELECTROSTATIC LATENT IMAGE BY A ONE-COMPONENT DEVELOPING AGENT

[75] Inventor: Mitsuaki Kohyama, Tokyo, Japan

[73] Assignee: Kabushiki Kaisha Toshiba, Kawasaki, Japan

[21] Appl. No.: 780,966

[22] Filed: Oct. 23, 1991

[30] Foreign Application Priority Data

Oct. 31, 1990 [JP] Japan ..... 2-291745

[51] Int. Cl.[5] ..... G03G 15/08

[52] U.S. Cl. ..... 118/653; 355/259

[58] Field of Search ..... 118/653, 652; 355/245, 355/246, 259

[56] References Cited

U.S. PATENT DOCUMENTS

| | | | |
|---|---|---|---|
| 3,152,012 | 10/1964 | Schaffert | 118/637 |
| 3,731,146 | 5/1973 | Bettiga et al. | 118/653 X |
| 3,866,574 | 2/1975 | Hardennrook et al. | 118/637 |
| 3,893,418 | 7/1975 | Liebman et al. | 118/637 |
| 3,929,098 | 12/1975 | Liebman | 118/653 |
| 4,406,536 | 9/1983 | Suzki et al. | 118/652 |
| 4,806,992 | 2/1989 | Yasuda et al. | 355/259 |
| 4,930,438 | 6/1990 | Demizu et al. | 355/259 X |
| 5,076,201 | 12/1991 | Nishio et al. | 118/653 |
| 5,095,341 | 3/1992 | Yoshida et al. | 355/259 |

FOREIGN PATENT DOCUMENTS

| | | | |
|---|---|---|---|
| 58-118678 | 7/1983 | Japan | 355/250 |
| 61-121071 | 6/1986 | Japan | 355/250 |

*Primary Examiner*—Joan H. Pendegrass
*Attorney, Agent, or Firm*—Foley & Lardner

[57] ABSTRACT

A developing device comprises a toner separating member placed in contact with a developing roller for developing a latent image on a photoconductive drum into a visible image with nonmagnetic toner conveyed as a one-component developing agent, and a toner feeding roller provided near the toner separating member. The toner separating member allows the toner which has passed on a developing position of the photosensitive drum to be separated from the developing roller. The toner feeding roller allows the separated toner to be transferred toward a toner receiving side of the developing roller.

2 Claims, 3 Drawing Sheets

DEVELOPING DEVICE FOR DEVELOPING AN ELECTROSTATIC LATENT IMAGE BY A ONE-COMPONENT DEVELOPING AGENT

BACKGROUND OF THE INVENTION

1. Field of the Invention

The present invention relates to a developing device for developing an electrostatic latent image into a visible image in an electrophotographic apparatus and electrostatic recording apparatus and, in particular, a developing device for obtaining a high-quality image using a one-component developing agent.

2. Description of the Related Art

Recently, a developing system using a one-component developing agent has been used in this field of art.

This developing system, differing from a developing system using a two-component (toner/carrier) type developing agent, obviates the necessity of providing a developing agent carrier, magnet roll, toner density control apparatus, etc. It is, therefore, possible to provide a compact, low-cost developing system.

The impression development method has been known as one of the developing methods using a one-component developing agent.

This method has the feature in that a toner carrier having a thin toner (developing agent) layer is brought into contact with an electrostatic latent image on a photosensitive drum at a substantially zero relative peripheral speed as disclosed in U.S. Pat Nos. 3,152,012 and 3,731,146 (IBM) and Published Unexamined Japanese Patent Applications 47-13088 and 47-13089.

The disclosed method ensures a simple and compact device and allows the use of color toner.

In the compression development method, the toner carrier is pressed against, or brought into contact with, a latent image on the photosensitive drum to effect development. It is, therefore, necessary to use a developing roller of proper elasticity and electroconductivity as the toner carrier. It is essential that, if an electrostatic image carrier is made up of a rigid structure, a developing roller be made up of an elastic body so as to prevent a possible damage to the image carrier.

U.S. Pat. Nos. 3,866,574 and 3,893,418, for example, disclose a non-contacting developing method as another one-component developing method.

This method comprises applying an AC electric field across a gap between a toner (developing agent) and an electrostatic latent image, on a photosensitive drum which is located near the toner side, to allow the toner to fly onto the latent image for development. It has been usual practice to form the developing roller as a rigid body.

It has generally been known that the use of the one-component developing method presents an image defect called a "sleeve ghost".

The generation of the sleeve ghost is ascribed to the state of formation of a toner layer on the developing roller. Stated in more detail, if, in a present development cycle, a toner-deposited area on the electrostatic latent image side is recovered under the same condition as in a previous development cycle in terms of a toner layer thickness, amount of charge-, etc., a toner density difference is produced between the two due to their "memory" difference.

The solutions to this problem are as set out below:

(1) a scraping member, such as a blade, is placed in contact with the developing roller to allow all the remaining toner to be removed from the developing roller at the completion of development. By so doing it is possible to eliminate the "memory" difference.

(2) A remaining deposited-toner is all removed, by a sponge and brush, from the developing roller at the completion of development to eliminate its "memory" difference.

(3) A bias voltage is applied to, for example, a conductive roller, moving the latter nearer the developing roller to electrostatically remove all the remaining toner left without being spent by development from the developing roller. In this way it is possible to eliminate the "memory" difference.

Either approach to this problem is to remove all the remaining toner from the developing roller at a time after a toner has been developed. By so doing, the "memory" difference on the developed pattern is removed. The aforementioned approach is reasonable from the standpoint of removing the cause involved.

However, either solution involves some problem.

In the solution (1), the developing roller is liable to be damaged by the blade and the material used, as well as the condition set, is restricted to an appreciable extent. It is also necessary to provide a means for conveying the once-removed toner again to a toner supply section. As a result, the arrangement becomes complex.

In the solution (2), the problem as pointed out by the approach (1) can be solved to some extent. Further, a stronger rubbing force is required to adequately remove the remaining toner by the means as set out below. An excessive burden is inflicted onto the associated device. This causes a variation of a rotational speed, etc., of the developing roller and a striped image defect is liable to be produced.

In the solution (3), a new electroconductive roller, bias power source, etc., are required as extra component parts and, in addition, the disadvantage as set out in the approach (3) remains to be solved.

SUMMARY OF THE INVENTION

It is accordingly the object of the present invention to provide a developing device which can effectively remove a remaining toner from a developing agent conveying means without applying any strong frictional contact force or load and, at the same time, transfer the removed toner again to a toner supply section without the need of adding any complicated mechanism.

A developing device for developing a latent image formed on an image carrier on a developing position by one-component developing agent comprises means for storing the one-component developing agent, means for conveying the one-component developing agent stored by the storing means to the image carrier, and means, located in contact with the conveying means and constituted in a single unit, for separating the one-component developing agent which has passed on the developing position from the conveying means and for simultaneously transferring the separated one-component developing agent to the storing means while the one-component developing agent is separated from the conveying means.

According to the present invention, the developing agent separated from the developing agent conveying means can be conveyed in readiness for the next cycle. That is, the separation and recirculation of the developing agent can be simultaneously achieved by the same means, obviating the need of providing any conventional, bulkier developing agent recirculation mechanism. The developing device of the present invention can fully erase a development "memory" on the developing agent conveying means and ensure a better developing operation free from any "sleeve ghost" defect.

Additional objects and advantages of the invention will be set forth in the description which follows, and in part will be obvious from the description, or may be learned by practice of the invention. The objects and advantages of the invention may be realized and obtained by means of the instrumentalities and combinations particularly pointed out in the appended claims.

BRIEF DESCRIPTION OF THE DRAWINGS

The accompanying drawings, which are incorporated in and constitute a part of the specification, illustrate presently preferred embodiments of the invention, and together with the general description given above and the detailed description of the preferred embodiments given below, serve to explain the principles of the invention.

DETAILED DESCRIPTION OF THE PREFERRED EMBODIMENTS

The embodiment of the present invention will be explained below with reference to FIGS. 1 to 3.

Figure 1:
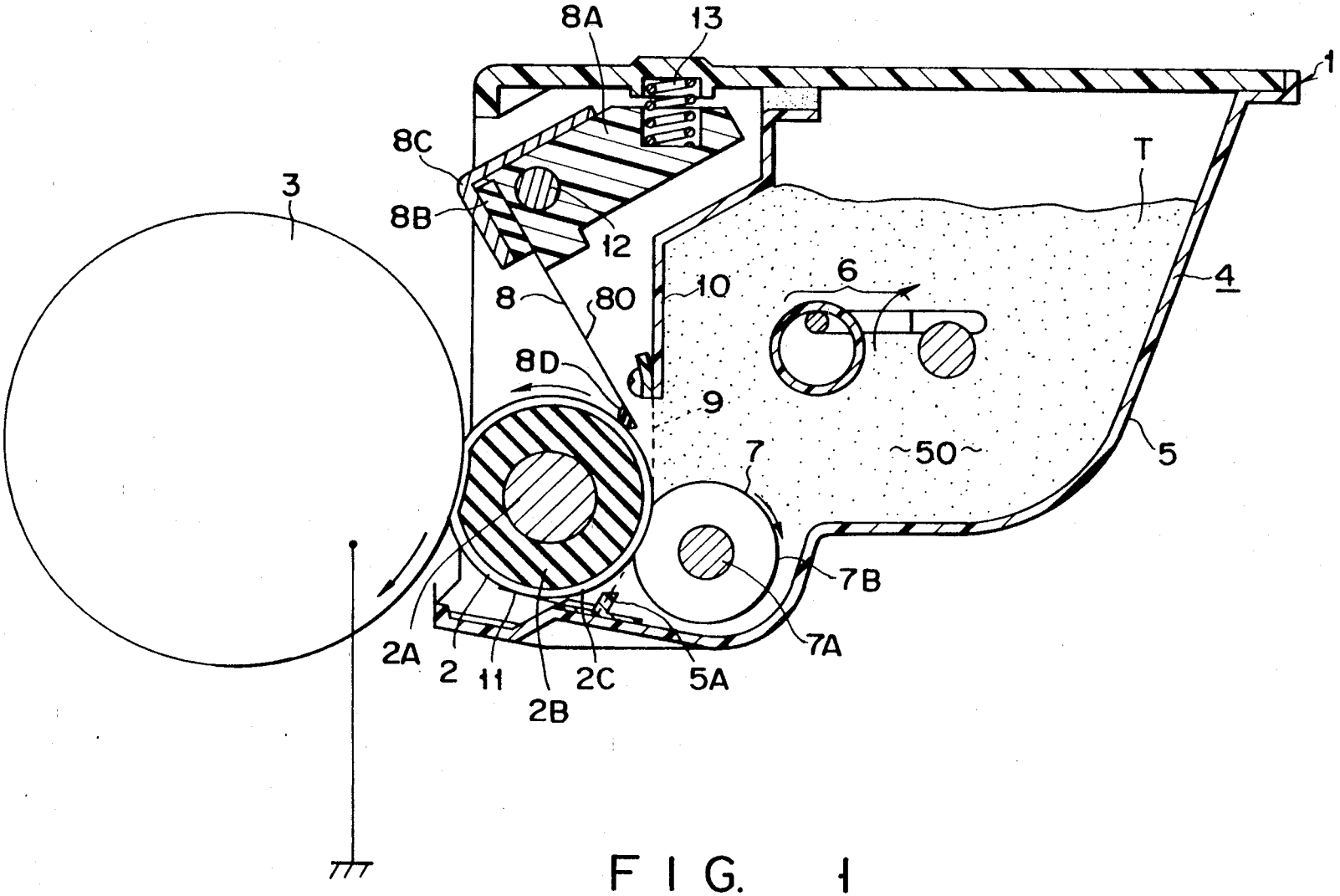
FIG. 1 is a cross-sectional view diagrammatically showing a developing device according to a first embodiment of the present invention.
Figure 2:
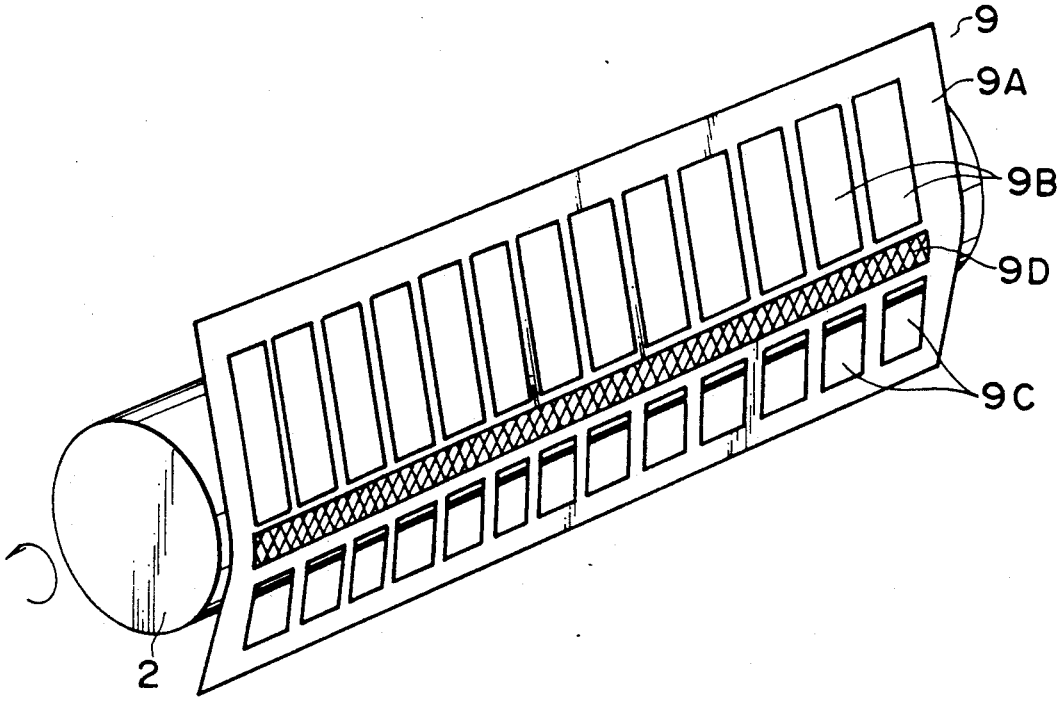
FIG. 2 is a perspective view diagrammatically showing a detail of a toner separating member, that is, a major section of the developing device of the present invention.

FIG. 1 is a cross-sectional view showing a developing device 1 according to a first embodiment of the present invention.

The developing device 1 can extensively be employed in a recording apparatus using an electrostatic recording method for electrophotograph. The recording apparatus is well known in this field of art. Only a photosensitive drum (latent image carrier) for the recording apparatus is shown in FIG. 1 and other component parts are omitted for brevity's sake.

For the photosensitive drum 3 use is made of a negatively charged organic photosensitive body.

The developing device 1 includes a device body 4 formed integral with a toner storage section 50 where the toner is stored. The device body 4 is opened at an area facing the photosensitive drum 3 and a developing roller 2 is provided, as a toner feeding or conveying means, in the neighborhood of that opening and contacts with the photosensitive drum 3.

The developing roller 2 is rotated at a speed about 1 to 4 times that of the photosensitive drum 3 in a direction of a with (opposed) mode relative to the photosensitive drum as indicated by an arrow in FIG. 1, while being deformed with a contact width of about 1 to 5 mm used as a nip between the developing roller 2 and the photosensitive drum 3. Against −350 to −700 V as the surface potential of the photosensitive drum, a bias voltage of −130 to −300 V for development is applied through a protection resistor of 3 to 10 MΩ to a metal shaft 2A of the developing roller 2.

A nonmagnetic toner T as a one-component developing agent is held in the toner storage section 50 and agitated by a mixer (agitating means) 6 to prevent toner agglomeration.

A toner feeding roller (toner feeding means) 7 is provided at the lower zone of the toner storage section 50 and in the neighborhood of, and at the back of, the developing roller 2 to allow the toner T which is agitated by the mixer 6 to be fed to the developing roller 2.

A blade (toner layer forming means) 8 is located relative to, and extends toward, the developing roller 2 and restricts an amount of toner to be fed by the developing roller 2 so that a toner layer is formed on the surface of the developing roller 2. A toner separating member (toner separating means) 9 having a mesh or network structure 9D as will be set out below is located between the toner feeding roller 7 and the developing roller 2 and stretched between a holder section 5A fixed to the bottom of a toner container 5 and an upper partition plate 10 formed integral with part of the toner container 5. In that state, the toner separating member 9 is pressed against the developing roller 2 over the length (effective developing length) of the developing roller 2.

A recovery blade (Mylar film) 11 is held by the holder section 5A such that it is placed in contact with the lower surface side of the developing roller 2.

At the time of the developing operation, the nonmagnetic toner T in the toner storage section 5 is agitated by the mixer 6 and sent to the toner feeding roller 7 and then to the developing roller 2 through the toner feeding roller 7.

Some of the toner T in the toner storage section 5 is conveyed to the drum 3 under both a mechanical conveying capacity by the developing roller 2 and an electrostatic force resulting from a friction between the surface of the developing roller 2 and the associated member. The toner T deposited onto the surface of the developing roller 2 has its conveying capacity controlled by the blade 8 and, at the same time, electrically charged by the friction between the toner and the developing roller.

In this way, the toner T is formed, as a thin layer, on the surface of the developing roller 2 and brought into contact with an electrostatic latent image on the surface of the photosensitive drum 3 to effect development.

Since, at this time, the toner T is frictionally charged even at the contacting site on the photosensitive drum 3, it is possible to obtain a very sharp image of less fogging.

The remaining toner T is returned back to the device body 4 past the recovery blade (Mylar film) 11. That toner T is scraped from the developing roller 2 by the fine-mesh structure 9D of the toner scraping member 9 and, upon being separated from behind, is swept up by the toner feeding roller 7 to allow some of it to be fed to the developing roller 2 in a subsequent developing cycle.

The blade 8 has its upper portion held in a manner to be sandwiched between a first blade holder 8A and a spacer 8B pressed by a second blade holder 8C. The first blade holder 8A is rotatably supported by a shaft 12 relative to the device body.

A plurality of compression springs 13 for pressure application are provided between the first blade holder 8A and a top plate of the device body 4. The first blade holder 8A is so spring-urged as to be clockwise rotated, in the state of FIG. 1, with the shaft 12 as a rotation center. A tip edge 8D is provided at the lower end of the blade 8*a* and, in the aforementioned state, pressed into contact with the developing roller 2.

The blade 8 comprises a thin leaf spring 80, such as stainless, beryllium copper or phosphorus bronze, and a semi-cylindrical tip edge (projection) 8D bonded to a substantially full length of the lower edge portion of one surface side of the thin leaf spring 80. By so doing, the tip edge 8D is pressed into contact with the developing roller 2 with a predetermined force of application.

In the aforementioned embodiment, a 0.2 mm-thick plate of phosphorus was employed as the thin leaf spring 80 and it may be possible to use a leaf spring of about 0.1 to 2 mm, depending upon its shape.

The tip edge (projection) 8D is comprised of an elastic element of rubber or resin, such as silicone rubber and urethane, having a JIS-A hardness of 30° to 85° and has its contacting radius set to be about 0.5 to 6 mm. A conventional charge control agent can be added to the tip edge, if necessary.

The mounting of the tip edge 8D to the thin leaf spring 80 may be accomplished by a bonding, fitting, sandwiching and other methods, if being accurately done.

Further, the compression springs 13 are so set to be lower in value than the spring constant of the thin leaf spring 80 of the blade 8. The tip edge 8D of the blade 8 placed in contact with the developing roller 2 undergoes almost no contact force even if it is worn off. It is, therefore, possible to maintain the formation of a better thin toner layer.

Since the thin leaf spring 80 of greater elasticity and elastic tip edge 8D of the cylindrical cross-section of the blade 8 compensate for a variation in compressing force and in accuracy of manufacture, the blade readily follows the motion of the developing roller 2 to provide a uniform thin toner layer.

This can be done for the reason as will be set out below.

That is, the tip edge 8D has a curvature area of a proper value at its forward half area to allow passage of a controlled amount of toner. Further, the backward half area of the tip edge 8D is placed in rubbing contact with the developing roller 2 and, therefore, the toner layer thus controlled at the forward half area can be positively rubbed and electrically charged.

In the aforementioned embodiment, the free end of the blade is located in the "against" position relative to the rotation of the developing roller 2 as shown in FIG. 1. According to the present invention, it is also possible to locate the free end of the blade in the "with" position.

In the present embodiment, since the negatively charged organic photosensitive body is used as the photosensitive drum 3, a negatively charged toner is used as the toner T and a negatively, readily chargeable material is used for the blade 8.

The toner feeding roller 7 serves the double function of supplying the toner T in the toner storage section 50 to the developing roller 2 and supplying the toner which has been scraped by the toner separation member 9 and floated up to the toner feeding roller side for reuse.

The toner feeding roller 7 comprises a metal shaft 7A and a flexible polyurethane foam layer 7B formed around the metal shaft and having an electroconductivity of the order of below $10^9\Omega$, a cell number of about 50 to 60 cells/25 mm and a density of 0.045 g/cm$^2$.

Further, the depth of contact of the toner feeding roller 7 with the toner separation member 9 is set to be about 0.2 to 1.0 mm and the rotational speed of the toner feeding roller 7 is set to be about ½ to 4 that of the developing roller 2 in an opposite rotation direction and a bias voltage is applied in a range between the same level as that on the developing roller 2 and about 100 volts. By so doing, it is possible to better perform the aforementioned double function and hence to obtain a better image.

It is preferable to confirm that the bias voltage be experimentally controlled, since it contributes to the amount of toner T to be transferred.

The force of contact between the toner separation member 9 and the toner feeding roller needs to be experimentally determined so as to obtain a optimal value, because it also contributes to the toner separation characteristic and toner recovery capacity.

The rotational directions of the developing roller 2 and toner feeding roller 7 are not restricted to those indicated in FIG. 1 and may be different from those shown in FIG. 1.

For the toner feeding roller 7 use may be made of not only the foamed polyurethane layer 7B but also a rotation brush and other proper materials, such as foamed silicone rubber, satisfying the mechanical demand or electrical characteristic.

The structure and function of the toner separation member 9 will be explained below with reference to FIG. 2.

The toner separation member 9 has the structure as set forth in more details below.

That is, the toner separation member 9 is formed of a film-like member 9A made of a material, such as stainless and polyester, and having a thickness of about 0.03 to 0.2 mm. The member 9 has openings 9B and 9C one at the upper side and one at the lower side with its area of contact with the developing roller as a boundary, the openings 9B and 9C being provided as many openings as large as possible but great enough to maintain their mechanical strength.

At the area of contact with the developing roller 2, the member 9 has the mesh or network structure 9D formed of thin lines, such as nylon fibers, stainless or steel, and is adapted to slidably contact with the developing roller 2 at a width of 2 to 10 mm in the longitudinal direction of the developing roller 2.

The network structure 9D has about 50 to 200-mesh size and, in either case, the lines are preferably as thin as possible.

In practice, a 10 to 50 μm-diameter structure can be easier to handle and is readily available.

The toner separation member 9 is stretched in the developing device at an area slidably contacting with the developing roller 2 with a proper level of pressure. By so doing, the toner layer on the developing roller 2 is sequentially scraped away from the developing roller 2 at the site of the network structure 9D.

The scraped toner, upon being passed through the meshes and floated up the network structure 9D, is immediately swept up from the toner feeding roller 7 as set out above in connection with FIG. 1.

The toner layer thus separated is, together with some toner in the toner storage section, supplied past the openings 9B to the developing roller 2 and formed, by the blade 8, as the toner layer and again used for development.

In this way, the toner is separated away from the developing roller 2 by the network structure 9D and, at the same time, swept upward, by the toner supply roller 7, from behind and again fed to the developing roller 2 past the openings 9B provided at the upper side of the network structure 9D.

By so doing, it is not necessary to provide any conventional, bulkier toner recirculation mechanism and it is, therefore, possible to completely eliminate the developing "memory" on the developing roller 2.

From the above it will be appreciated that it is possible to naturally use a generally known network structure and that various changes or modifications of such a structure can be made without being restricted to the aforementioned mesh or network structure.

The present embodiment ensures a very high developing sensitivity and a maximal density of about 1.4 can stably be obtained at a surface potential of −500 V and bias voltage of −200 V.

The toner is subjected to frictional contact at the position of development and triboelectrically charged, enabling a very sharp image to be obtained with less fogging. The remaining toner is returned back to the recovery blade 11 past the recovery blade 11.

Those other component parts of the developing device 1 of the present invention will be explained in more detail below.

Figure 3:
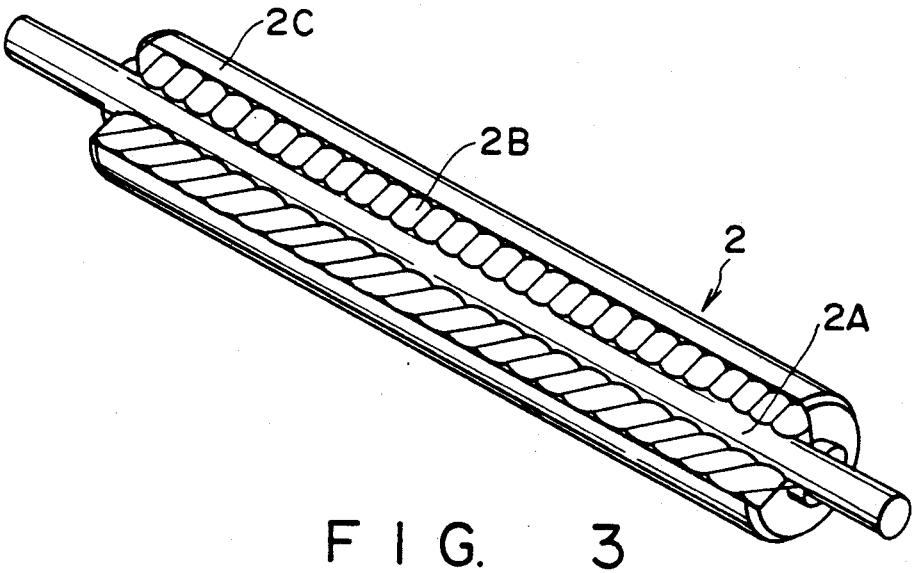
FIG. 3 is a perspective view, in cross-section, showing a major section of the present developing device.

FIG. 3 is a perspective view showing the developing roller 2 in cross-section.

In the developing system of the present developing device, two features are required for the developing roller 2, that is, an electroconductive feature and elastic feature are required as primary features. A simple, satisfactory approach to this requirement provides a combination of a metal shaft and conductive rubber roller. For this reason, a smooth surface is required to convey the toner while being in contact with the surface of the developing roller 2. According to the present invention, the elastic layer 2B and surface conductive layer 2C are formed around the metal shaft 2A as shown in FIG. 3.

As the elastic layer 2B, use can be made of a conductive layer or a nonconductive layer, but it is desirable to employ the conductive layer, taking into consideration a possible separation and damage.

Since the elastic layer 2B is placed in contact with the blade 8 and photosensitive drum 3, a greater load is required against a greater rubber hardness to obtain a predetermined nip, eventually leading to a greater torque increase for the developing device 1.

At the time of packing or standing over a prolonged period of time, there is a problem called permanent deformation that is defined in Japanese Industrial Standard JISK 6301. The deformation, exceeding about 10%, causes a variation in the cycle of the developing roller relative to an image. It is, therefore, necessary to reduce the compression deformation of the elastic layer 2B below 10% or, preferably, below 5%.

The relation of the rubber hardness to the permanent deformation has such a tendency that, generally, the greater the rubber hardness, the smaller the permanent deformation. It is, therefore, important that a balance be required for the choice of such material.

After the developing roller 2 receives deformation by the blade 8, the toner is fed from the surface of the developing roller to the photosensitive drum 3. In this case, if the deformation being involved exerts adverse influence over the development, it has to be returned back to the initial state.

The rubber hardness of the elastic layer 2B is below 35 or, preferably, below 30, while, on the other hand, the rubber hardness of the conductive layer 2C is below 35 or, preferably, below 30.

The conductive layer 2C is formed on the elastic layer 2B by spraying a conductive urethane based coating on the surface of the elastic layer or dipping. Since the conductive layer 2C is placed in direct contact with the toner T and photosensitive drum 3, it is made of such a type that it never contaminates the toner and photosensitive drum 3 caused by the oozing out of a plasticizer, vulcanizable agent, process oil, etc.

The conductive layer 2C has a surface smoothness of, desirably, 3 to 5 μm $R_Z$ and is liable to produce a striped pattern corresponding to the unevenness of a surface. In order to achieve the surface smoothness of 3 μm $R_Z$, a conductive layer 2C of adequate thickness is formed on the elastic layer 2B, followed by a post-forming such as polishing, to obtain a predetermined shape of given surface roughness. In order to achieve such a layer without any such post-forming step so that no high cost is involved, it is so done by optimally the surface roughness of the elastic layer 2B, thickness of the conductive layer 2C and viscosity of the coating.

That is, the lower the viscosity of the coating and the greater the surface roughness of the elastic layer 2B, the greater the thickness of the conductive layer 2C it is necessary to make.

In terms of the viscosity of the coating, it is necessary to change the viscosity in a coating layer (change a dilution level), even if being the same, in accordance with the coating method.

For an additional requirement for the developing roller 2, use is made, as an elastic layer 2B, of conductive silicone rubber having a hardness of below 35° under JIA-A, elongation of about 250 to 500% and resistive value of below 1×107 Ω·cm and, as a conductive layer 2C, of a conductive polyurethane coating, such as a trade name "SPALEX" manufactured by NIPPON MIRACTRON Co., Ltd., having a resistive value of $10^4$ to $10^6$ Ω·cm and elongation of about 100 to 400%. In this case, for example, the developing roller as a whole has a rubber hardness of about 30° to 40°.

On the elastic layer 2B whose surface roughness is about 5 to 10 μm, a conductive layer 2C of about 50 to 200 μm was formed by the spray-coating method and, even in this case, a developing roller 2 of a surface roughness of about 3 μm $R_Z$ was able to be obtained. It was also possible to obtain a better image.

Although, in the present invention, the conductive silicone rubber and conductive polyurethane coating have been explained as being formed on the metal shaft 2A to obtain the developing roller, other proper materials may of course be used if they satisfy the aforementioned characteristics.

According to the present invention, as already set out above, the toner T is separated by the network structure 9D away from the developing roller 2 and some separated toner, together with the toner in the toner storage section, is swept up by the toner feeding roller from behind. Then the toner is again supplied to the developing roller past the opening 9B at the upper side of the network structure 9D.

This obviates the need for providing any conventional bulkier toner recirculation mechanism and can fully remove the developing "memory" on the developing roller 2.

If, as the developing method, use is made of the contact development method employing the elastic roller, it is possible to provide a very simple developing device, ensuring a high image quality.

Figure 4:
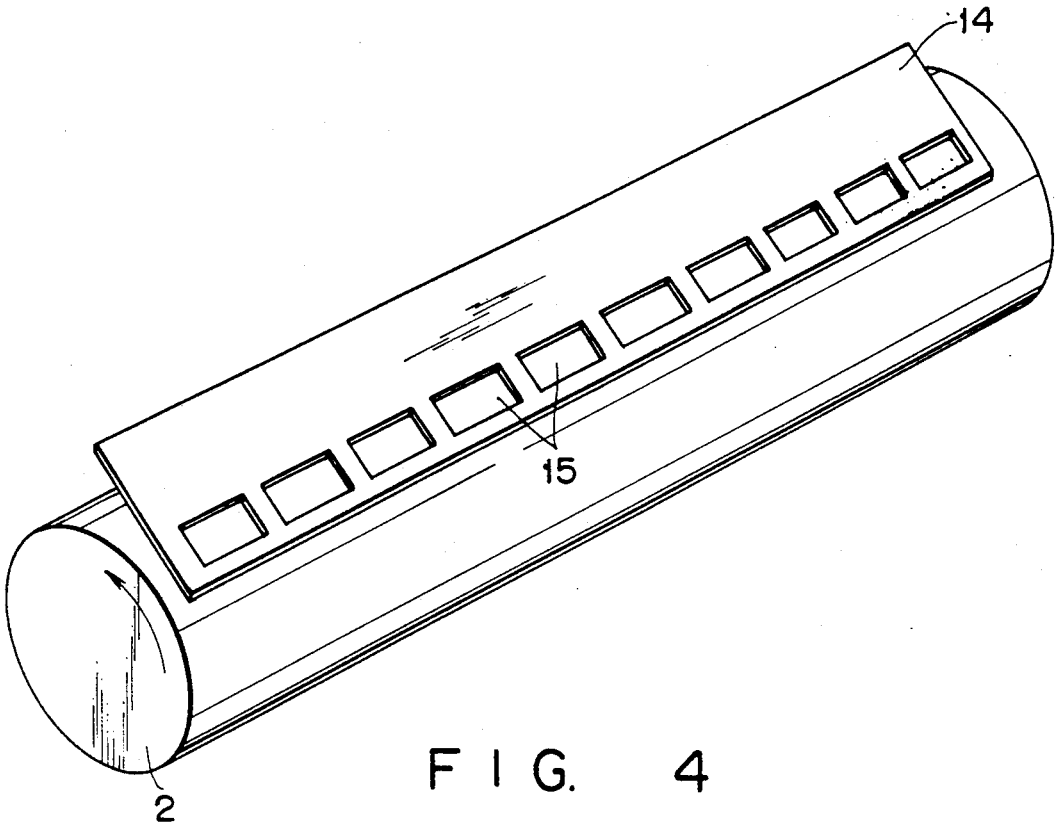
FIG. 4 is a perspective view diagrammatically showing another embodiment of the present invention.
Figure 5:
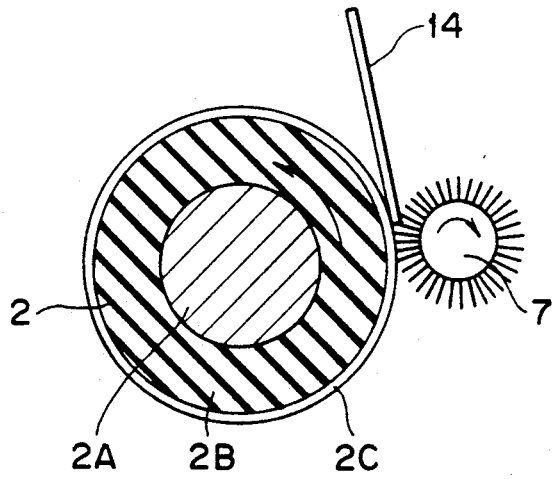
FIG. 5 is a diagrammatic view showing another embodiment of the present invention.

As seen from the above, the present invention is characterized in that it is possible to separate the toner from the surface of the developing roller and, at the same time, transfer it to a recirculation-ready state. It is possible to, as shown in FIGS. 4 and 5, place a blade 14 in contact with the developing roller 2 and separate the toner with a rotation of the developing roller and recirculate it by a toner feeding roller 7 as a rotating member comprised of a brush as set out above, the blade 14 having a proper tip edge and openings (toner passing openings) 15 in the neighborhood of the tip edge.

The present invention is not restricted to the aforementioned embodiments. Various changes or modifications of the invention can be made without departing from the spirit and scope of the present invention.

Additional advantages and modifications will readily occur to those skilled in the art. Therefore, the invention in its broader aspects is not limited to the specific details, and representative devices, shown and described herein. Accordingly, various modifications may be without departing from the spirit or scope of the general inventive concept as defined by the appended claims and their equivalents.

What is claimed is:

1. A developing device for developing a latent image formed on an image carrier on a developing position by a one-component developing agent comprising:

means for storing the one-component developing agent;

means for conveying the one-component developing agent stored by the storing means to the image carrier; and separating/transferring means, placed in contact with the conveying means, for separating the one-component developing agent which has passed the developing position from the conveying means, while transferring the separated one-component developing agent to the storing means;

wherein the separating/transferring means comprises a film-like member having a network structure formed of thin lines, and arrays of openings along each side of the network structure with the longitudinal direction of the network structure as a boundary, the separating/transferring means being adapted to slidably contact with the conveying means.

2. A developing device for developing a latent image formed on an image carrier on a developing position by a one-component developing agent, comprising:

means for storing the one-component developing agent;

means for conveying the one-component developing agent stored by the storing means to the image carrier;

layer forming means having a semi-cylindrical tip edge pressed in contact with the conveying means for forming, as a thin layer, the one-component developing agent which is conveyed to the developing position by the conveying means;

removing means placed in contact with the conveying means for removing, from the conveying means, the one-component developing agent which has passed the developing position; and means, positioned relative to the conveying means, and in the same contact position as the removing means, for feeding the one-component developing agent which is removed by the removing means to the storing means.

* * * * *